US005702138A

United States Patent [19]

Elkind

[11] Patent Number: 5,702,138

[45] Date of Patent: Dec. 30, 1997

[54] COLLECTOR/CARRIER FOR ANIMAL EXCREMENT

[76] Inventor: Jules Elkind, 4387 Jasmine, Culver City, Calif. 90232

[21] Appl. No.: 823,802

[22] Filed: Mar. 24, 1997

[51] Int. Cl.[6] ..... A01K 29/00; E01H 1/12

[52] U.S. Cl. ..... 294/1.4; 15/257.4

[58] Field of Search ..... 294/1.3–1.5, 51, 294/55; 15/104.8, 257.1, 257.2, 257.4, 257.6, 257.7

[56] References Cited

U.S. PATENT DOCUMENTS

| | | | |
|---|---|---|---|
| 675,052 | 5/1901 | Carlson | 15/257.2 |
| 3,170,183 | 2/1965 | Leatherman | 15/257.2 X |
| 3,827,098 | 8/1974 | Sanderson | 294/1.4 |
| 4,146,260 | 3/1979 | Carrington | 294/1.5 |
| 4,222,597 | 9/1980 | Willis | 294/1.4 |
| 5,033,781 | 7/1991 | Flood | 294/1.4 |
| 5,343,589 | 9/1994 | Davenport | 15/257.4 |
| 5,379,481 | 1/1995 | DeMars | 15/257.2 X |

*Primary Examiner*—Johnny D. Cherry
*Attorney, Agent, or Firm*—Monty Koslover

[57] ABSTRACT

An animal refuse collector/carrier device consisting of a long rectangular plastic container having a hinged cover at its top with a long rigid carrying handle attached to the cover. Included is a shovel with a collection scoop that is stored inside the container and secured to the handle. A disposable plastic bag is placed inside the container to hold animal feces retrieved using the shovel. The carrying handle includes a hook for fastening a leash while walking a pet. All the materials used, except for the shovel handle, are made of hard plastic and molded to obtain smooth surfaces for easy cleaning. The device is light in weight and inexpensive.

5 Claims, 2 Drawing Sheets

11
12
14
16
18
10
22
20
4
8
6
2

COLLECTOR/CARRIER FOR ANIMAL EXCREMENT

BACKGROUND OF THE INVENTION

1. Field of the Invention

This invention relates to collection devices and more particularly to a device for collecting and carrying animal excrement prior to disposal.

2. Background

There are numerous collection devices in the prior art that are intended for use in picking up the droppings of pet dogs and cats. U.S. Pat. Nos. 4,741,566, 5,056,842, 4,951,987, 5,380,054 and 5,540,469 describe devices typical of this prior art. While the foregoing devices apparently can suitably perform their designated function, an inspection of pet equipment stores indicates a lack of pet owner demand and interest in these often complex devices, and consequently few such devices are offered for sale.

The average pet owner, walking his or her dog in suburbia, simply carries plastic bags and sometimes a small shovel to help pick up the excrement. This method is not deemed satisfactory by anyone, but it is simple and inexpensive, which apparently is what pet owners want.

There is then a need for an animal excrement collection and carrier device that is simple in construction and is inexpensive.

SUMMARY OF THE INVENTION

The invention comprises a long box-shaped container having a hinged cover at one end with a long rigid carrying handle attached to the cover. Included is a shovel that is stored held inside the container, gripping an edge of the container and secured to the handle. When in use, a disposable plastic bag is placed inside the container box to hold animal feces retrieved by use of the shovel. The carrying handle includes a means for fastening a leash while walking a pet.

Accordingly, it is a principal object of this invention to provide a collector/carrier for animal excrement that is simple in construction, economical to manufacture and inexpensive.

Another object is to provide a collector/carrier that will hold collected animal excrement hidden from view, and is light in weight.

Further objects and advantages of the invention will be apparent from studying the following portion of the specification, the claims and the attached drawings.

DESCRIPTION OF THE PREFERRED EMBODIMENT

Figures 1, 2, 3:
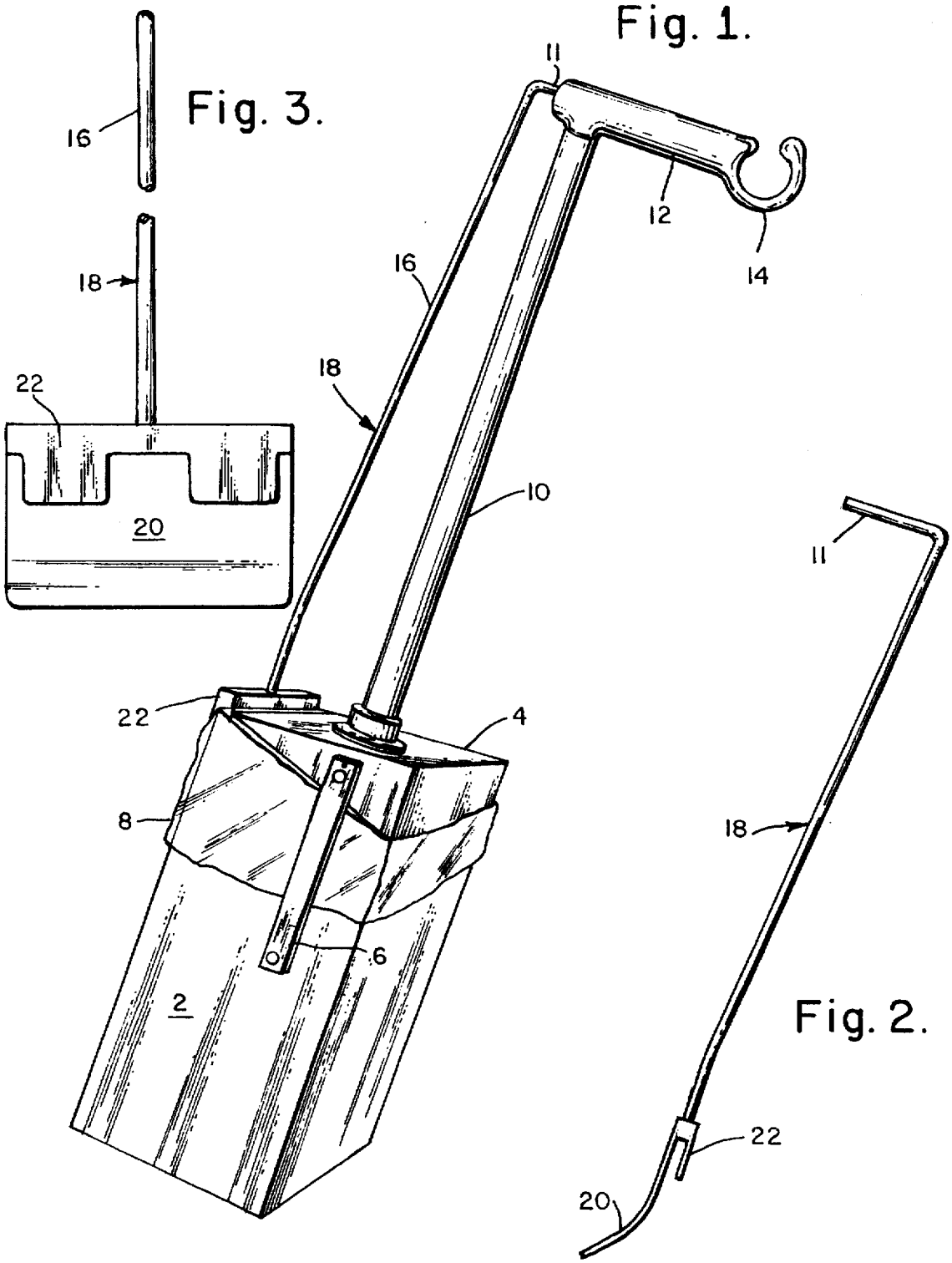
FIG. 1 is a perspective view of the collector/carrier device according to the present invention, particularly showing a disposable plastic bag in place to receive collected animal excrement, and a stored shovel.
FIG. 2 is a side elevation view of a shovel according to the present invention, that is to be used for collecting animal excrement.
FIG. 3 is a partial, rear plan view of the shovel, particularly showing a clip portion that is used to clip the shovel inside the container for storage.

Referring particularly to the drawings, there is shown in FIG. 1 a perspective view of a collector/carrier for removal of animal wastes according to the present invention.

The collector/carrier is made of essentially four parts or assemblies: a rectangular container 2 open at one end, a cover 4 which is attached by hinges 6 to the container 2, a carrier handle assembly 10 which is attached to the top of the cover 4, and a shovel 18 which is stored in the device when being carried.

All parts of the device except for the shovel handle 16 are made of rigid, molded plastic to obtain a light carrying weight.

Figure 5:
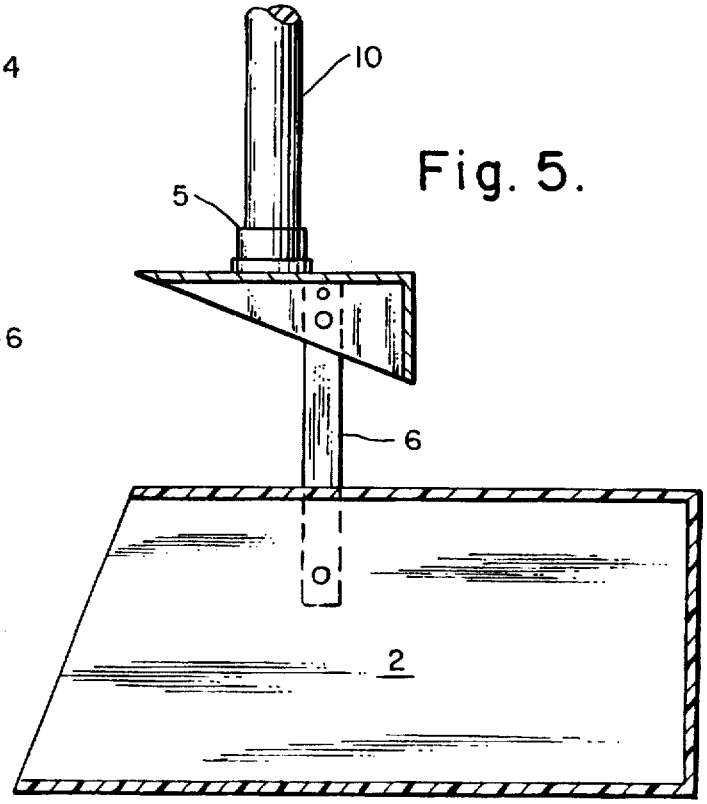
FIG. 5 is a partial, cut-away view of the carrier container and handle, showing the container with its cover hinged open.

For collecting animal refuse, the shovel 18 is first removed from its stored position and the container cover 4 is swiveled open as shown in FIG. 5. The container 2 is placed with its long face on the ground, with the opening towards the animal refuse. There should already be a plastic bag 8 hung inside the container edges 2 to receive the refuse which is picked up and inserted using the shovel 18. The shovel 18 can then be replaced, hooked over an open edge at the front of the container, and the cover 4 swung closed on the shovel and plastic bag.

The shovel handle 16 has its free end bent at an angle forming a hook portion 11. This hook portion 11 is inserted in a hole bored in the grip portion 12 of the carrier handle 10 which retains the shovel and locks the unit together, preventing the container from swinging open. The container then becomes a closed vessel and the contents can not be spilled. The refuse odor is also closed off and does not escape.

The unit is designed to work with any plastic bag of a sufficient size for containing and disposing the refuse. No special bags are required. Similarly, the shovel scoop is shaped and sized so that it may be covered with a few standard sheets of toilet tissue or a plastic bag to keep the shovel blade clean.

A hook 14 is provided on the grip portion 12 of the carrier handle 10 and designed to hold a dog leash, allowing a person walking a dog to keep one hand free to use the shovel when needed.

Refer now to FIGS. 2 and 3 which illustrate details of the shovel 18. The shovel is made of a metal rod handle 16 joined to a molded plastic scoop 20. The scoop 20 has a wide, outward curving surface to assist in picking up the animal refuse. Attached, molded to the back of the scoop 20 blade is a short, downward projecting clip 22 which fits over the top open edge of the container 2 as a holding clip when the scoop 20 is stored inside it.

The free end of the shovel handle 16 is bent at an angle to form a short projection 11 at an approximate right angle to the axis of the rod and the front surface of the scoop 20. This projection 11 is for the purpose of securing the shovel handle to the unit carrier handle grip 12.

Figure 4:
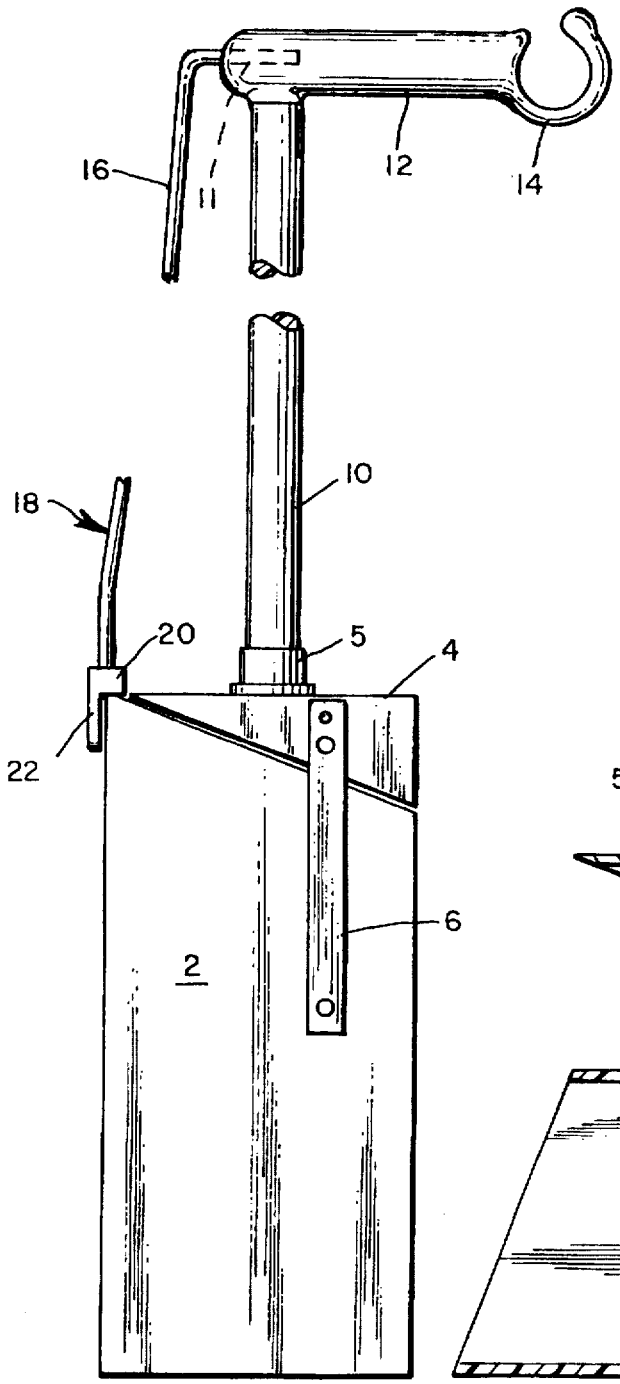
FIG. 4 is a partial, side elevation view of the carrier/collector device.
Figure 6:
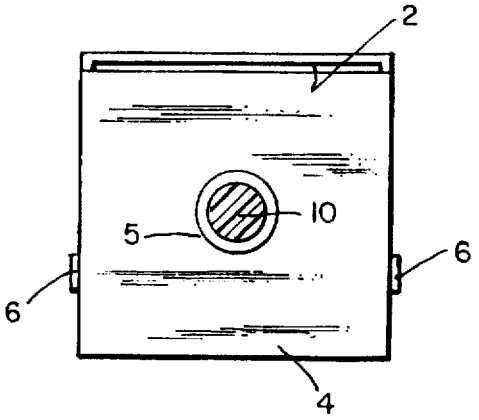
FIG. 6 is a top view of a closed container, with the carrier handle cut and removed for clarity.

Refer now to FIGS. 4, 5 and 6. Two plastic hinges 6, one on both sides, are located fastening the container cover 4 to the container box 2. These hinges permit the container to be opened by rotating the carrier handle outwards. Alternate hinge arrangements are also possible, including for example, a single plastic hinge attached at the back of the cover 4. The illustrated approach is, however, considered as optimum for this application, because it allows the user to pull the cover well back, providing a clear view of the open front receptacle of the container when inserting collected animal refuse.

The carrier handle 10 comprises three parts which are assembled. These are a mounting boss 5, an elongated rigid tube member and a handle grip 12. The handle grip 12 is sized and shaped for ease of gripping and includes a hook 14 formed in one end for holding a pet leash. An axial hole is bored in the distal end of the grip 12 to hold the end 11 of the shovel handle 16.

The handle tube member is fastened with one end in the boss 5 opening and the other end attached to the handle grip 12 so that the grip forms an "L" shape with the tube member. The boss 5 is then glued to the top surface of the container cover 4. Alternately, the boss 5 may be first glued or otherwise fastened to the top center surface of the cover 4, before the handle tube member is fastened in the boss 5.

In order to make it easier to clean the device, all surfaces are kept smooth and devoid of extraneous projections wherever possible. All corners are rounded and internal corners in the container and cover have radii incorporated.

The following characteristics and advantages of the invention collector/carrier device are notable:

1. The "L" shaped carrying handle helps to eliminate hand and wrist fatigue.
2. The container becomes a closed vessel when being carried, preventing its contents from being accidently spilled or allowing refuse odor to escape.
3. A separate shovel is used for collection of the refuse. This shovel scoop is designed to store inside the container, so the outside stays clean and odor free.
4. The unit works with any plastic bag of sufficient size. No special container bags are needed.
5. The device molded plastic design creates a light, yet strong unit, making it easy to carry.
5. The device is provided with smooth, easily accessible surfaces and can be easily washed with soap and water.
6. The device is light in weight, simple to use and inexpensive.

From the above description, it is clear that the preferred embodiment achieves the objects of the present invention. Alternative embodiments and various modifications may be apparent to those skilled in the art. These alternatives and modifications are considered to be within the spirit and scope of the present invention.

Having described the invention, what is claimed is:

1. An animal refuse collecting and carrying device comprising a shovel having a first portion adapted to be a collecting scoop and a second portion adapted to be grasped by an operator;

an elongated rectangular container, having flat sides and a slanted open end with a leading edge thereof to define a collection receptacle, said container being sized to receive a disposable plastic bag positionable therein;

a container cover, said cover being sized to completely close said open end of said container, providing an aperture space for said collecting scoop to be inserted inside said open end and be supported by said container;

means for hinging said cover to said container, permitting said cover to be swung fully open without obstructing said collection receptacle; and a rigid carrier handle, having a first portion defined as a grip for grasping by an operator, a second portion being an elongated rigid tubular member, said tubular member being attached at its top to one end of said grip at an angle of approximately 90 degrees to the longitudinal axis of said grip, and attachment means at the bottom end of said tubular member for affixing said tubular member perpendicular to the center top surface of said container cover, said tubular member being affixed in an orientation such that said grip projects backwards from said tubular member away from the front leading edge of said container to alleviate hand carrying fatigue.

2. A device according to claim 1 wherein said collecting scoop includes a retaining clip portion mounted to the top back surface of said scoop, said retaining clip portion being mounted to fit over an open edge at the top of said container and holding said collecting scoop inside said container.

3. A device according to claim 1 wherein said second portion of said shovel is an elongated metal rod of approximately the same length as said tubular member, said metal rod being attached at one end to the top end of said collecting scoop, and having an outwardly bent portion at its opposite end for insertion in said grip of said carrier handle, said metal rod serving as a shovel handle.

4. A device according to claim 3 wherein said grip in said carrier handle includes an axial hole bored in one end to receive and hold closely said bent length at the end of said shovel handle, thereby holding said shovel securely stored and said container cover tightly closed.

5. A device according to claim 1 wherein said grip in said carrier handle includes a hook formed in one end, said hook being shaped and sized for connecting thereto the looped end of a pet walking leash.

* * * * *